US009487272B2

(12) United States Patent
Bauer

(10) Patent No.: US 9,487,272 B2
(45) Date of Patent: Nov. 8, 2016

(54) SYSTEMS AND METHODS FOR TENSIONING MOORING LINES AT THE SEAFLOOR

(71) Applicant: Intermoor Inc., Morgan City, LA (US)

(72) Inventor: Thomas C. Bauer, Bellaire, TX (US)

(73) Assignee: Intermoor, Inc., Morgan City, LA (US)

( * ) Notice: Subject to any disclaimer, the term of this patent is extended or adjusted under 35 U.S.C. 154(b) by 0 days.

(21) Appl. No.: 14/657,048

(22) Filed: Mar. 13, 2015

(65) Prior Publication Data

US 2015/0259043 A1 Sep. 17, 2015

Related U.S. Application Data

(60) Provisional application No. 61/953,269, filed on Mar. 14, 2014.

(51) Int. Cl.
*B63B 21/24* (2006.01)
*B63B 21/50* (2006.01)
*B63B 21/26* (2006.01)

(52) U.S. Cl.
CPC ..... *B63B 21/50* (2013.01); *B63B 21/26* (2013.01); *B63B 2021/505* (2013.01)

(58) Field of Classification Search
CPC .. B63B 21/26; B63B 21/50; B63B 2021/505
USPC ..... 114/293
See application file for complete search history.

(56) References Cited

U.S. PATENT DOCUMENTS 5,927,904 A 7/1999 Treu et al.
6,009,825 A 1/2000 Fulton et al.
6,122,847 A 9/2000 Treu et al.
2002/0189522 A1 12/2002 Dove et al.
2007/0017429 A1 1/2007 Riggs
2013/0309020 A1 11/2013 Tomas et al.
2014/0026796 A1 1/2014 Leverette et al.

FOREIGN PATENT DOCUMENTS

GB 2484840 9/2012

OTHER PUBLICATIONS

International Search Report, PCT/US15/20413, Jun. 22, 2015, 2 pgs.
First Subsea Ltd., Protos Principals, Printed From Internet Mar. 2, 2015; 2 pgs.
Bruce Anchor Limited, The Bruce Tensioner, Printed From Internet Feb. 4, 2014; 2 pgs.

(Continued)

*Primary Examiner* — Stephen Avila
(74) *Attorney, Agent, or Firm* — Egan Peterman Enders Huston

(57) ABSTRACT

Systems and methods are disclosed for deploying one or more anchor piles on the seafloor using submersible line tensioning systems and techniques to achieve tensioning of mooring lines at the seafloor rather than at the conventional vessel deck level. Among other things, the disclosed systems and methods may be advantageously employed for tensioning mooring lines for Mobile Offshore Drilling Units (MODUs) when additional mooring legs must be added to the original complement of MODU legs, as well as and for tensioning mooring lines for vessels having turret mooring systems, each of which have limited space for surface tensioning equipment.

30 Claims, 6 Drawing Sheets

(56) References Cited

OTHER PUBLICATIONS

Vryhof Anchors, Stevtensioner VA 600 & VA 1000, Printed From Internet Feb. 4, 2014; 2 pgs.
Bardex Corporation, Products, BarLatch Fairlead Stopper, Printed From Internet Feb. 24, 2014, 2 pgs.
IHC Merwede Offshore Systems, Keeping Floating Facilities Secure, Chain Stoppers, Printed From Internet Feb. 24, 2014, 1 pg.
Bardex Corporation, Products, Gripper Jacks, Printed From Internet Feb. 24, 2014, 3 pgs.
Bardex Corporation, Products, Linear Chain Jacks, Printed From Internet Feb. 24, 2014, 2 pgs.
IHC Merwede Offshore Systems, Keeping Floating Facilities Secure, Chain Jacks & Winches, Printed From Internet Feb. 24, 2014, 1 pg.
IHC Merwede Offshore Systems, Keeping Floating Facilities Secure, Chain Fairleads, Printed From Internet Feb. 24, 2014, 1 pg.
Timberland Equipment Limited, Timberland Product Guide, Printed From Internet Feb. 24, 2014, 2 pgs.
LHR Marine, Mooring Product Guide, Printed From Internet Mar. 3, 2015, Introductory pages and pp. 82-83, total of 7 pgs.
Irizar Forge, Forging Hooks for Handling and Lifting Industry, ROV Hook, Printed From Internet Mar. 3, 2015, 3 pgs.
GN Rope Fittings, Printed From Internet Mar. 3, 2015, Introductory pages and "hooks" page, total of 7 pgs.
GN Rope Fittings, KS Hook, Available From Internet Prior to Mar. 14, 2014 filing date of U.S. Appl. No. 61/953,269 to which the correct patent application claims priority, 1 pg.
First Subsea, Subsea Mooring Connector, Printed From Internet Mar. 2, 2015, 2 pgs.
Balltec Subsea Mooring Connectors, Moor Lok, Subsea Mooring Connectors, Printed From Internet Mar. 2, 2015, 2pgs.
First Subsea, Subsea Mooring Connector, Printed From Internet Mar. 2, 2015, 3 pgs.
First Subsea, Image Gallery, Printed From Internet Mar. 2, 2015, 3 pgs.

*SECTION A-A*

*SECTION B-B*

SYSTEMS AND METHODS FOR TENSIONING MOORING LINES AT THE SEAFLOOR

This application claims the benefit of U.S. Provisional Patent Application Ser. No. 61/953,269, filed on Mar. 14, 2014 and entitled "SYSTEMS AND METHODS FOR TENSIONING MOORING LINES AT THE SEAFLOOR", which is incorporated herein by reference in its entirety for all purposes.

FIELD OF THE INVENTION

This invention relates generally to mooring systems and methods for drilling vessels and other types of vessels.

BACKGROUND

Conventional mooring systems for Mobile Offshore Drilling Units (MODU), Floating Production Storage & Offloading (FPSO) and Floating Storage & Offloading (FSO) vessels rely on pre-tensioning of their respective mooring lines by means of winches, windlasses or chain jacks mounted on the vessel itself. Mounting of mooring line tensioning equipment on the deck of a vessel is generally not a problem for a MODU or a FPSO or FSO that is equipped with a spread mooring. However, deck-mounting of tensioning equipment may be difficult or impossible under some circumstances, such as when a MODU needs to add additional mooring legs (e.g., for compliance with requirements by the Bureau of Safety and Environmental Enforcement (BSEE) for drilling in the Gulf of Mexico during the hurricane season), and when a FPSO or FSO is equipped with an internal or external turret mooring system. For example, in the case of a MODU originally designed for eight mooring legs, but that now requires twelve mooring legs, it is often difficult to accommodate four more tensioning systems and associated chain lockers required for the four additional legs. In the case of a FPSO or FPO with a turret mooring system, it is very difficult to mount mooring tensioning equipment on the turret due to lack of space.

SUMMARY OF THE INVENTION

Disclosed herein are systems and methods for tensioning (e.g., pre-tensioning, re-tensioning, etc.) vessel mooring lines at the seafloor rather than at or on a vessel itself. In one embodiment, the disclosed systems and methods may be employed to install and utilize pile-tensioned mooring systems for mooring seagoing vessels such as Mobile Offshore Drilling Units (MODUs), Floating Production Storage & Offloading (FPSO) vessels, Floating Storage Offloading (FSO) vessels, etc. In such an embodiment, the disclosed systems and methods may be advantageously implemented using submersible mooring line tensioner equipment or apparatus that is positioned away and apart from a vessel to be moored, and instead that may be located on individual anchor structures such as anchor piles (e.g., suction piles, driven piles, etc.) that are submerged in the water, so as to facilitate tensioning of the vessel mooring lines without requiring deck-mounting of additional tensioning equipment on the vessel, and in one embodiment to enable tensioning of mooring lines connected to a floating vessel (e.g., such as a dynamic-positioning (DP) MODU or other type of floating vessel) that itself has no mooring line winches and/or otherwise without applying any tension to the mooring line from the floating vessel. Such mooring line tensioner equipment or apparatus may be permanently attached or otherwise permanently associated or integrated with each individual anchor structure, or may be modular in nature, e.g., so as to allow a single mooring line tensioner to be moved from one submerged anchor structure to another submerged anchor structure to sequentially tighten the individual mooring lines between each anchor structure and a seagoing vessel. Advantageously, the disclosed systems and methods may be employed in one exemplary embodiment to tension mooring lines of a DP MODU that has no mooring line winches in a manner that reduces the carbon footprint of the DP MODU. In another embodiment, the disclosed systems and methods may be employed in another exemplary embodiment to tension mooring lines of a FPSO or FPO that has a turret mooring system with no mooring tensioning equipment on the turret.

In one exemplary embodiment, a modular and submersible mooring line tensioner, such as a submersible chain jack or gripper jack, may be provided that is configured for temporary installation on a submerged mooring line anchor structure, such as an anchor pile that is submerged in the water and engaged with or otherwise anchored to the seafloor. A submersible modular chain-tensioner may be further configured to manipulate a mooring line that extends from the anchor structure up to a vessel so as to tighten or tension a segment of the mooring line between the anchor structure and the vessel. In one exemplary embodiment, a mooring line tensioner may include one or more integrated actuators (e.g., hydraulic pneumatic actuator, electric motor, etc.) that provides the drive action that is required to tighten the mooring line. Such an integrated actuator may be powered by an external power source (e.g., such as an external hydraulic, pneumatic or electric power source) that is contained, for example, on a remotely operated vehicle (ROV). Alternatively, a mooring line tensioner may be entirely self-contained and include an integrated or internal power source (e.g., such as battery, compressed gas tank, etc.) that provides the type and amount of power required to power the actuator of the mooring line tensioner. In yet another embodiment, a modular mooring line tensioner may include no actuator, but instead be actuated by an external actuator, e.g., such as power take off (PTO) or remote arm of a ROV.

In one respect, disclosed herein is a method for tensioning a mooring line coupled to a vessel floating on a surface of a body of water that overlies a seafloor, including: coupling one or more segments of the mooring line to extend from the floating vessel to a submerged anchor pile that is at least partially embedded in the seafloor; and using a submerged line tensioner that is coupled to and mechanically supported by the submerged anchor pile to apply tension to the mooring line between the floating vessel and the submerged anchor pile.

In another respect, disclosed herein is a submersible line-tensioning system, including: an anchor pile having an upper end and a lower end, the anchor pile being configured to be coupled while submerged to one or more segments of a mooring line that is coupled to a floating vessel while the lower end of the anchor pile is embedded in a seafloor; and a submersible line-tensioner that is configured to be coupled to and mechanically supported by the anchor pile and to apply tension to the mooring line extending between the floating vessel and the anchor pile while the anchor pile is submerged and the lower end of the anchor pile is embedded in the seafloor.

DESCRIPTION OF ILLUSTRATIVE EMBODIMENTS

Figure 1:
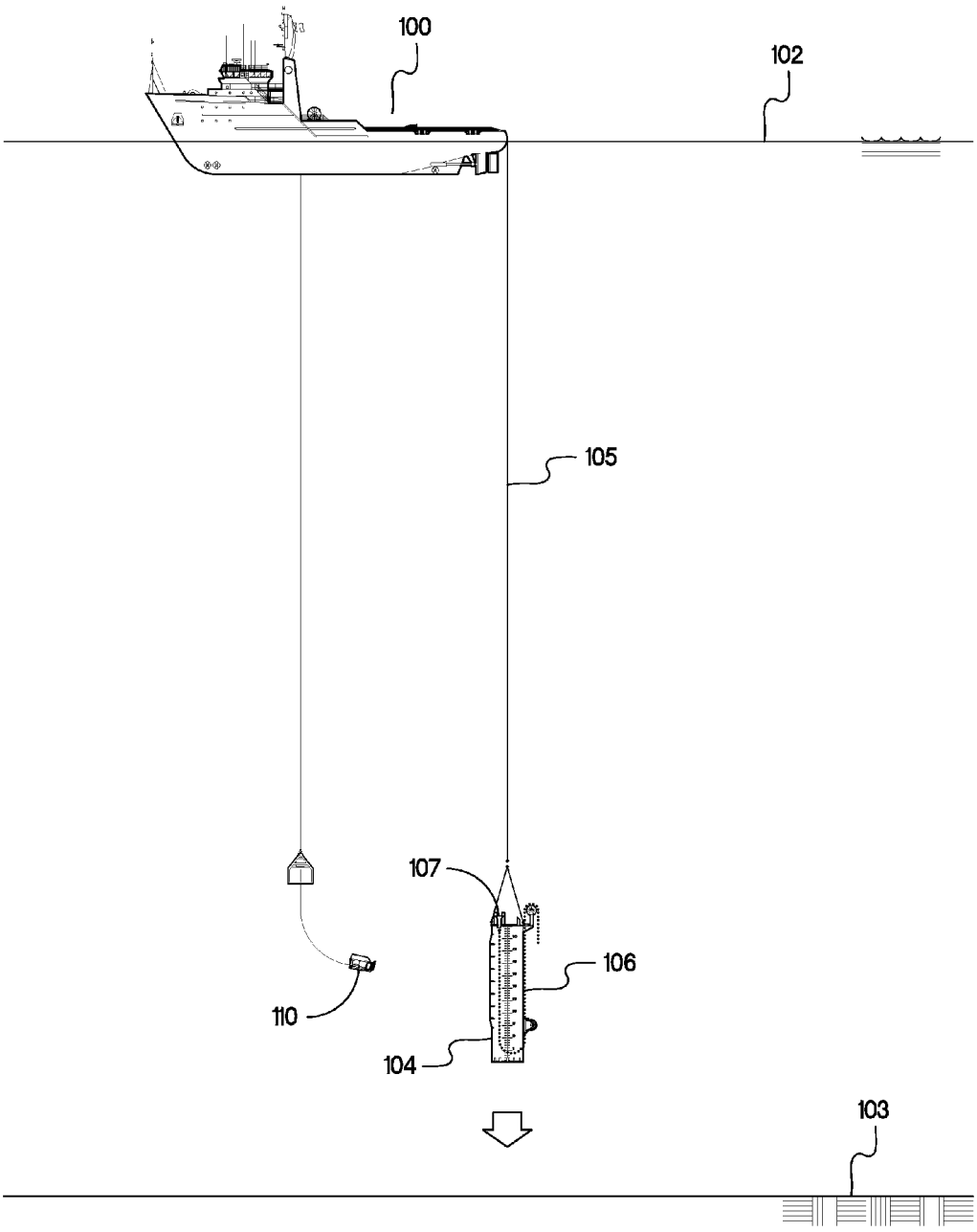
FIG. 1 illustrates installation of a suction pile anchor from an Anchor Handling Vessel (AHV) according to one exemplary embodiment of the disclosed systems and methods.

FIG. 1 shows one exemplary embodiment of a specially outfitted anchor pile 104 being installed from an installation vessel 100. For purpose of illustration, anchor pile 104 is illustrated as a suction pile anchor herein. However, it will be understood that in other embodiments an anchor pile 104 may be instead, for example, a driven pile or other type of anchor pile. In this exemplary embodiment, the installation vessel 100 is depicted as an Anchor Handling Vessel (AHV) although other vessel types may be employed as an installation vessel, e.g., a CAHV construction anchor handling vessel (CAHV) outfitted with an integral crane, multi-service vessel (MSV), crane ship, a semi-submersible crane vessel SSCV, etc.

Figure 3:
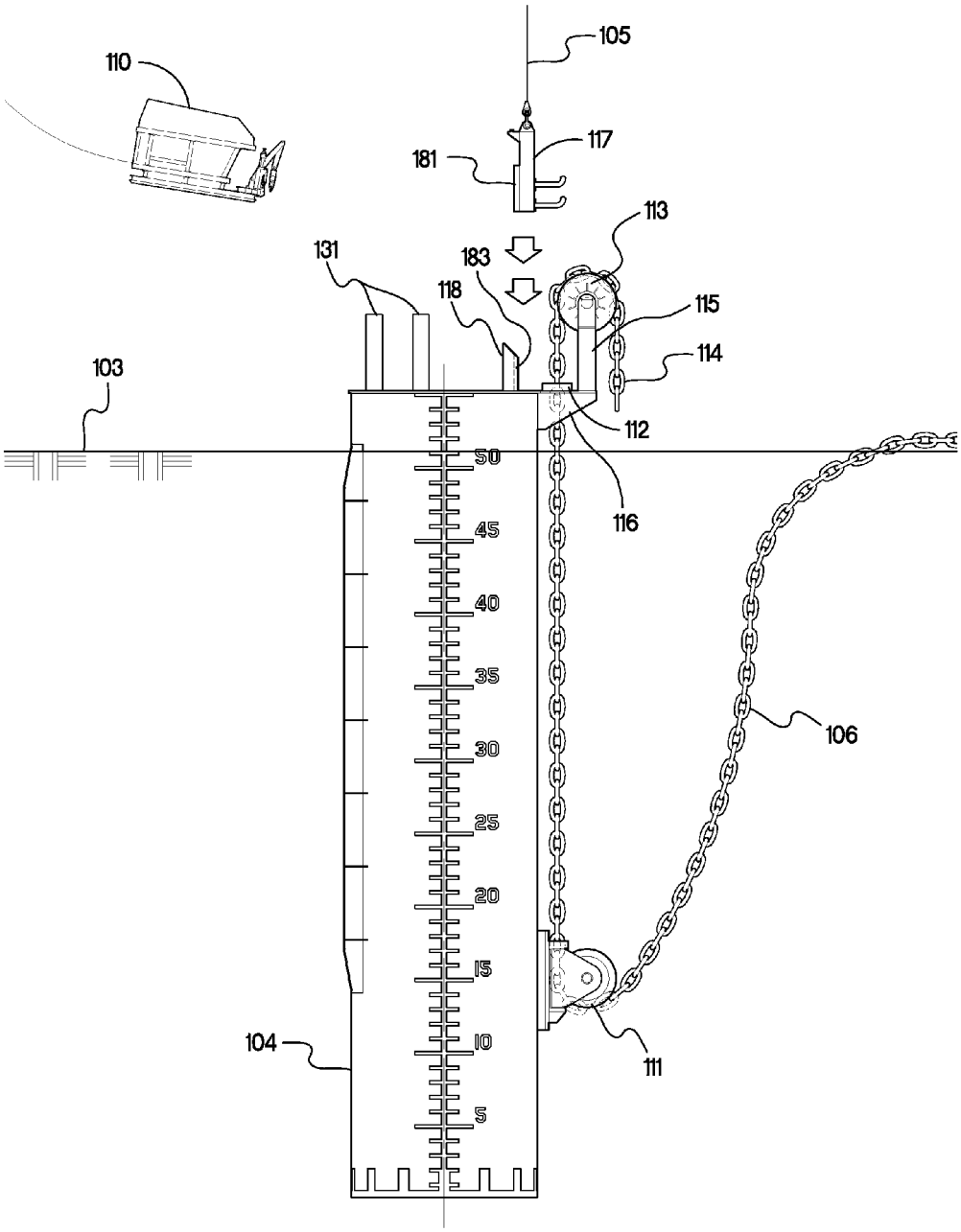
FIG. 3 illustrates a submersible line-tensioning system including a suction pile anchor with assembled mooring system components according to one exemplary embodiment of the disclosed systems and methods.
Figure 4A:
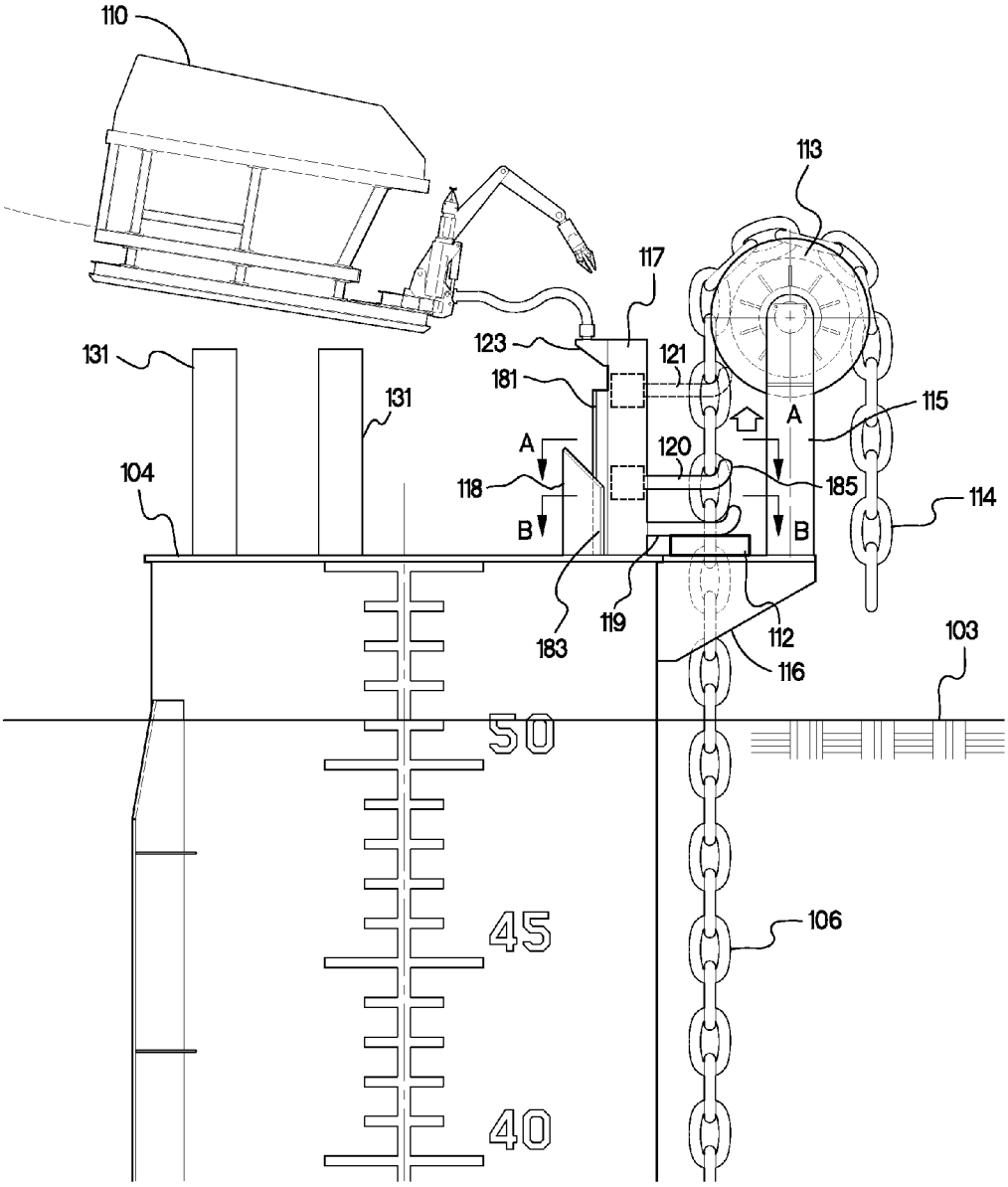
FIG. 4A illustrates a line-tensioner of the submersible line-tensioning system disposed in operative relationship with the suction pile anchor of FIG. 3 according to one exemplary embodiment of the disclosed systems and methods.

In the illustrated embodiment of FIG. 1, suction pile anchor 104 may be a conventional suction anchor that is specially configured with additional components for tensioning a connected mooring line at the seafloor 103, including an anchor forerunner line segment 106 (e.g., chain, cable, etc.) and subsea mooring connector part 107 that may be pre-installed and held until needed on top of the suction pile anchor within a complementary shaped and dimensioned subsea mooring connector receptacle 131 that is further illustrated herein in FIGS. 3 and 4A. Examples of suitable subsea mooring connectors include, but are not limited to, two part ball and taper style subsea connectors such as Ballgrab® connectors available from First Subsea Ltd. of Lancaster United Kingdom, and MoorLOK™ subsea mooring connectors available from Balltec of Lancashire United Kingdom. As further described herein, upon completion of the method, the anchor forerunner line segment 106 will become the lowermost segment of the overall mooring line. Also depicted is the lowering line 105 and a Remotely Operated Vehicle (ROV) 110 used for various functions typical of suction pile anchor installation. Further information on suction pile anchor installation techniques and apparatus that may be employed in conjunction with the practice of the disclosed systems and methods may be found, for example, in U.S. Pat. No. 6,009,825, which is incorporated herein by reference in its entirety for all purposes.

Figure 2:
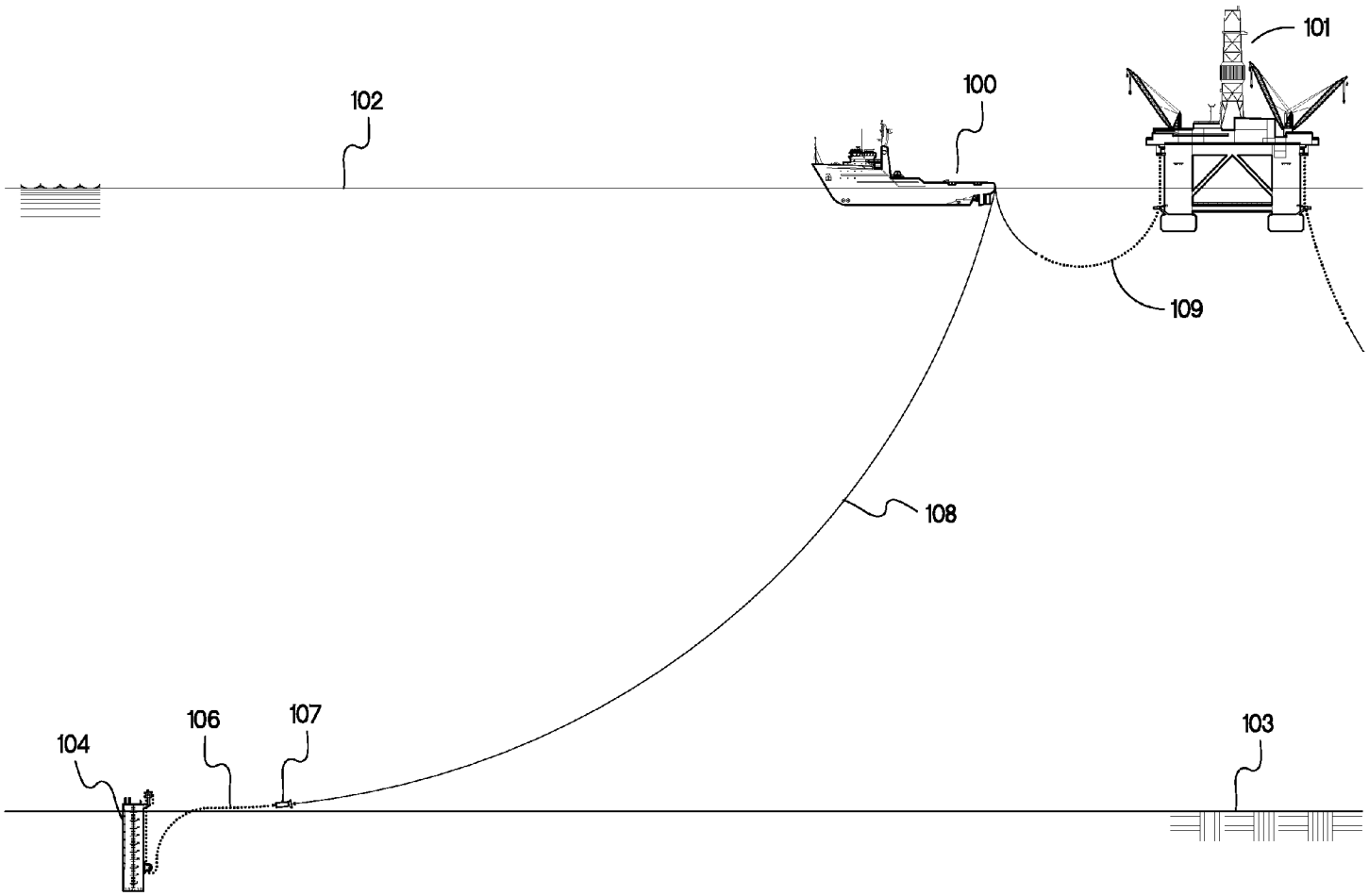
FIG. 2 illustrates the deployment and connection of a mooring line between a suction pile anchor and a moored vessel according to one exemplary embodiment of the disclosed systems and methods.

FIG. 2 shows the installation vessel 100 of FIG. 1 coupling the already deployed middle segments 108 of a mooring line to a moored vessel 101 floating at the sea surface 102 via an uppermost segment 109 of the mooring line that has been pre-installed to the moored vessel 101. In this exemplary embodiment, the connection between the middle segments 108 and uppermost segment 109 is made on board the installation vessel 100. As further illustrated in FIG. 2, middle segments 108 have been coupled to anchor forerunner line segment 106 by the subsea mooring connector part 107 (e.g., which has been removed from receptacle 131 by ROV 110 and mechanically coupled to a mating subsea connector attached to the lower end of middle segments 108) although any other suitable connection apparatus and/or technique may be employed to couple middle segments 108 to anchor forerunner line segment 106, e.g., including but not limited to Type HK12 "KS Hooks" available from GN Rope Fittings of Nieuwkoop, The Netherlands; "KS Hooks" available from LHR Marine of Aberdeen United Kingdom; and "ROV Hooks" available from Irizar Forge Lifting and Mooring of Gipuzkoa, Spain. At the stage illustrated in FIG. 2, the mooring line includes the anchor forerunner line segment 106, subsea mooring connector part 107, mooring line middle segments 108 and mooring line upper segment 109, and is relatively slack. It will be understood that the moored vessel 101 may or may not have the ability to adjust mooring line tension.

FIG. 3 illustrates one exemplary embodiment of a submersible line-tensioning system that includes mooring system components that may be added or otherwise assembled to a suction pile anchor 104 prior to launching the anchor 104 into the water from AHV 100 or other suitable vessel. Also depicted is deployment of a modular and submersible mooring line tensioner (line-tensioning device) 117 of the submersible line-tensioning system downward onto and in operative engagement with the suction pile anchor 104 (e.g., lowered into the water from AHV 100 using lowering line 105 as shown, or using any other suitable technique such as lowering suction anchor 104 on a crane line for crane-outfitted construction anchor handling vessels "CAHVs") after the suction pile anchor 104 has been embedded into the seafloor 103 so as to enable subsequent tensioning of an attached mooring line via pre-installed forerunner line segment 106. In this regard, it will be understood that the disclosed systems and methods may be employed to tension a mooring line coupled to a submerged anchor pile that has been sufficiently embedded (e.g., at least partially or fully embedded) into the seafloor to resist and maintain a selected or otherwise applied amount of line tension so as to enable subsequent tensioning of an attached mooring line coupled to a floating vessel via forerunner line segment 106 using a submersible mooring line tensioner 117. In this embodiment, the line tensioner 117 is provided in the form of a submersible chain jack, although any other mechanism or device that is configured to engage or otherwise manipulate a forerunner line segment 106 to apply tension to the anchor forerunner line segment 106 so as to increase tension in a mooring line coupled to the forerunner line segment 106, e.g., such as in a manner described further herein.

As shown in FIG. 3, anchor forerunner line segment 106 may be fed through an optional mooring line fairlead 111 (in this case a wheel-type chain fairlead) disposed between an upper and lower end of anchor 104 in position to receive the anchor forerunner line segment 106, up the side of the suction pile anchor 104 and through a line tension holder (line tensioning retention device) 112, that in this embodiment includes a chain stopper having a one-way flapper mechanism, prior to launching the anchor 104 into the water from AHV 100 or other suitable vessel. It will be understood that other types of line tension holders may alternatively be employed (e.g., a cable gripper if the anchor forerunner line was cable instead of chain, etc.). It will also be understood that a mooring line fairlead 111 may be integrated into or onto the structure of the suction pile anchor 104, or otherwise securably attached to anchor 104 in any other suitable manner. As shown in FIG. 3, such a mooring line fairlead 111 may in one exemplary embodiment be mounted in a position that is closer to the lower end of suction pile anchor 104, e.g., mounted by a distance downward from the upper end of suction pile anchor 104 toward the lower end of suction pile anchor 104 that is equal to from about two-thirds to about three-quarters of the total length of suction pile anchor 104 so as to optimize the horizontal holding capacity of the embedded suction pile anchor 104 in the seafloor 103. However, it will be understood that in other embodiments a mooring line fairlead 111 may be mounted at other positions that are closer or further away from the lower end of suction pile anchor 104.

Although mooring line fairlead 111 is illustrated as being a wheel-type chain fairlead 111 in FIG. 3, it will be understood that a mooring line fairlead 111 may alternatively be any other device/s suitable for receiving and redirecting forerunner line segment upward along the side of anchor 104, e.g., a turning shoe, fixed guide, chute, bending shoe, chain welp, sheave, etc. Particular examples of suitable line tension holders include, but are not limited to, chain stoppers available from IHC Merwede of The Netherlands and Timberland Equipment Limited of Ontario, Canada. Particular examples of suitable mooring line fairleads include, but are not limited to, chain fairleads available from IHC Merwede of The Netherlands and Timberland Equipment Limited of Ontario, Canada.

Still referring to FIG. 3, line tension holder 112 may in one embodiment be mounted at or adjacent the upper end of anchor 104 as shown, although a line tension holder 112 may be alternatively mounted at any other position between the upper and lower ends of anchor 104 that is suitable for allowing forerunner line segment 106 to move through in an upward direction during line tensioning operations while restricting downward movement of forerunner line segment 106 to permanently resist and maintain created tension in the mooring line. As further shown in FIG. 3, an optional line slack deflector 113 (line slack deflection device such as a turndown sheave illustrated in this embodiment) may be provided to help redirect and clear slack forerunner line away from the anchor 104. In other embodiments, a line slack deflector 113 may be of any other suitable configuration for redirecting slack of forerunner line 106 during mooring line tensioning operations, e.g., such as a fixed guide, chute, etc. In the illustrated exemplary embodiment, turndown sheave of line slack deflector 113 is shown supported by a turndown sheave support structure 115 which may be, for example, a vertical or upwardly-extending steel arm of sufficient length configured to place the turndown sheave at a sufficient height above the top of suction pile anchor 104 so as to operably accommodate the length of a mated submersible line tensioner 117 in the operative configuration described further below. In the illustrated exemplary embodiment, line tension holder (in this case a chain stopper) 112 is supported by an optional cantilevered chain stopper support structure 116 which transfers load from the chain stopper into the suction pile anchor 104. Chain stopper support structure 116 may be, for example, a horizontal or sideways-extending steel bracket or arm which is configured to place the line tension holder in position for operably engaging forerunner line 106 in a manner described further below. It will be understood, however, that any other suitable mounting support configurations may be employed for a line tension holder 112 and/or a line slack deflector 113.

FIG. 3 shows submersible line tensioner 117 (in this embodiment a chain jack that is adapted for subsea use) being lowered beneath the water surface into position onto (e.g., in contact and operative engagement with) the suction pile anchor 104 where it may be employed to adjust mooring line tension at the submerged subsea location of the anchor pile 104, rather than from the moored vessel 101 and above the sea surface as is conventionally done. As shown, a line tensioner 117 may be guided into position and at least partially stabilized and/or secured in position to anchor pile 104 by an optional line tensioner guide and support structure 118 (e.g., slot/s and or rail/s configured to engage to hold a chain jack in place) which may be integrated into the structure of suction pile anchor 104 on the upper end of the anchor 104, for example in a manner as illustrated and described further herein with regard to FIGS. 4A and 4B. It will be understood that in those embodiments where a driven pile is employed, a landing provision (e.g., a chain jack or line tensioner porch optionally including a line tensioner guide and support structure 118, turndown sheave 113, turndown sheave support structure 115, line tension holder 112, and anchor forerunner line segment 106) for receiving the line tensioner may be placed on the upper end of the driven pile after the pile has been driven in the seafloor to grade, as may be one or more other components of a submersible line-tensioning system, such as anchor forerunner line segment 106, mooring line fairlead 111, and line tension holder 112. Such a line tensioner porch may be configured to extend beyond the periphery of the pile as desired or needed where diameter of the pile is too small to contain the needed equipment in operational relationship.

Although a submersible line tensioner 117 in the form of a submersible chain jack is illustrated, it will be understood that any other suitable submersible apparatus configuration may be employed that is suitable for manipulating forerunner line segment 106 while submerged to apply tension to a mooring line as further described herein, e.g., such as powered chain winch, gripper jack, etc.

Once mated and coupled with the anchor pile 104, the line tensioner 117 is mechanically supported by the anchor pile 104, with the anchor pile 104 providing a stationary and anchored platform to which line tensioner 117 is secured (e.g., by line tensioner guide and support structure 118) and from which line tensioner 117 may exert a sufficient force on the anchor forerunner line segment 106 that is required to tension the mooring line as described further herein. Together, line tensioner 117 and line tension holder 112 may form a submerged anchor pile-mounted line-tensioning system, and in one embodiment these two components may be optionally integrated together into a single component. As further shown, a ROV 110 may be used to provide visual cues for landing a line tensioner 117 onto the anchor 104.

Figure 4B:
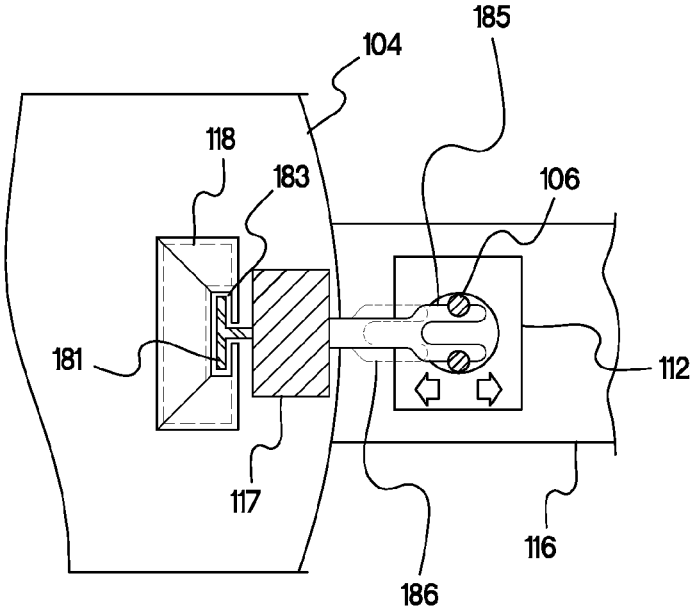
FIG. 4B illustrates overhead sectional views of the submersible line-tensioning system of FIG. 4A according to one exemplary embodiment of the disclosed systems and methods.
Figure 4B:
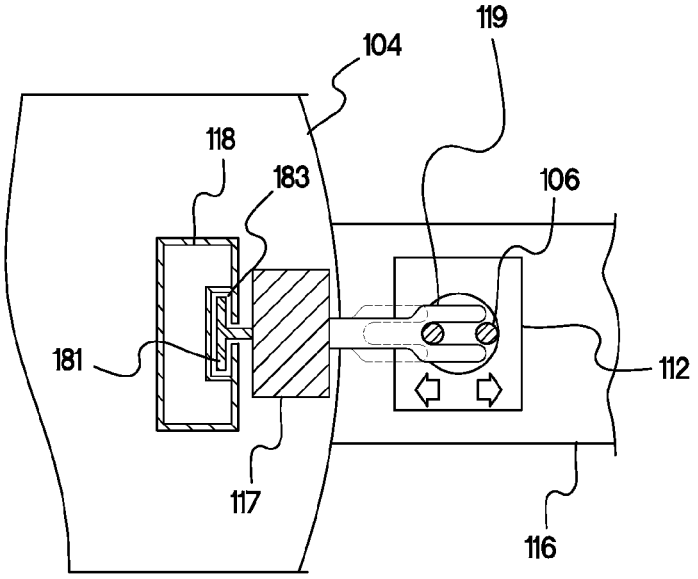

FIG. 4A illustrates a submersible chain jack of line tensioner 117 that has been submerged and received in operational position on the upper end of anchor 104. In this regard, chain jack of line tensioner 117 is shown oriented in correct position and at least partially stabilized by the line tensioner guide and support structure 118. FIG. 4B illustrates an overhead sectional view of the submersible line-tensioning system of FIG. 4A showing chain jack of line tensioner 117 mated with line tensioner guide and support structure 118 according to one exemplary embodiment. As shown in FIG. 4B, a slot or channel 183 is defined within line tensioner guide and support structure 118 that is shaped and dimensioned to slidably receive a complementary shaped and dimensioned T-shaped rail 181 that extends as shown from one side of chain jack of line tensioner 117 as shown (e.g., when chain jack of line tensioner 117 is lowered downward onto and in operative engagement with the suction pile anchor 104 using lowering line 105 as shown in FIG. 3). When so received within channel 183, rail 181 secures chain jack of line tensioner 117 on top of anchor pile 104 in operative relationship with forerunner line segment 106 and line tension holder 112 as shown. After completing mooring line tensioning operations for the given anchor pile 104, line tensioner 117 may be uncoupled and retrieved from the submerged anchor by raising chain jack of line tensioner 117 (e.g., using attached lowering line 105 from AHV 100) so as to slide rail 181 upwards and out of engagement with channel 183, e.g., in a manner further described herein. It will be understood that the illustrated embodiment of channel 183 of line tensioner guide and support structure 118 and mating complementary rail 181 of line tensioner 117 is exemplary only, and that any other suitable mechanism for temporarily or permanently securing a line tensioner 117 in operative relationship to a top of an anchor pile 104 may be employed.

In the exemplary embodiment of FIGS. 4A and 4B, ROV 110 may be maneuvered and positioned to provide hydraulic power from a ROV hydraulic pump to hydraulically actuated chain jack of line tensioner 117, which may be so actuated to pull the chain of anchor forerunner line segment 106 upwards through the chain stopper line tension holder 112 to increase tension in the mooring line. In one embodiment, ROV 110 may be a standard work-class ROV modified with an additional hydraulic pump for operating the line tensioner 117, e.g., with the motor for the pump using the ROV's internal hydraulic system of the ROV 110 for the necessary flow. As illustrated, in this exemplary embodiment, the chain jack mechanism of line tensioner 117 may be configured with two or more forks (or stoppers or hooks) schematically shown in simplified illustration of FIG. 4A to hold and pull against individual chain links of forerunner line segment 106. The forks may be moved by action from hydraulic cylinders which are powered by hydraulic fluid provided from ROV 110.

Particular examples of suitable line tensioners that may be modified for submersible use include, but are not limited to, Bardex linear chain jacks and gripper jacks available from Bardex Corporation of Houston, Tex.; chain jacks available from IHC Merwede of The Netherlands; and chain jacks available from Timberland Equipment Limited of Ontario, Canada. Examples of modifications that may be made to such line tensioners include, but are not limited to, the addition of a standard ROV switch and power interface to allow a ROV to control and/or power operation of the submerged line tensioner, as well as any other appropriate modifications to render the line tensioner capable of withstanding high pressures and water environment associated with deep water operation (e.g., such as provision of high pressure seals and packing boxes, electrical components certified and designed for deep water operation, etc.).

In the illustrated exemplary embodiment of FIG. 4A, two forks 185 and 119 are used as shown in the simplified schematic illustration of FIG. 4A. In this regard, the first (moving) fork 185 is configured to move upward from position 120 to 121 while the moving fork 185 is extended and engaged with the chain of forerunner line segment 106 so as to impart an upward linear motion to the chain of forerunner line segment 106. Second fork 119 does not move vertically up and down, and is configured to extend to engage and hold the chain in a stationary position while the moving fork 185 is retracted into position 186 (shown in dashed outline in Section A-A of FIG. 4B) and is resetting downward from position 121 to 120, where it once again may be extended outward into engagement with the chain of forerunner line segment 106 before moving upward again. Second fork 119 is configured to retract and disengage from the chain of forerunner line segment 106 in a similar manner as first fork 185 (as shown in Section B-B of FIG. 4B) while the first fork 185 is extended and engaged with the chain of forerunner line segment 106 and is moving upward from position 120 to 121 so as to allow upward linear motion to the chain of forerunner line segment 106 past the retracted and disengaged second fork 119. In the illustrated embodiment, stability and guidance for the forks is provided by a body of the chain jack of line tensioner 117 which in this embodiment also interfaces with the line tensioner guide and support structure 118 via mating rail 181 as described further below. In this exemplary embodiment, power and control may be provided from the ROV 110 to a chain jack hydraulic system of chain jack of line tensioner 117 via industry standard (such as described in API Specification 17D) "hot-stab" interface 123, it being understood that other types and configurations of power and control interfaces may be provided between a ROV 110 and a line tensioner 117.

In the illustrated embodiment of FIG. 4A, back tension allowing the chain to travel over the turndown sheave 113 is provided by gravity acting on the loose end 114 of the chain forerunner line segment 106. Once the desired tension is achieved on the various connected mooring line segments coupled to moored vessel 101 by the reciprocating moving fork action of chain jack of line tensioner 117, the moving fork 185 of the chain jack may be lowered to transfer permanent tension load back to the chain stopper 112. The chain jack (or other type of line tensioner mechanism or device 117 in other embodiments) may be optionally removed from anchor 104 at this time. In the illustrated embodiment, the forks of chain jack of line tensioner 117 may be operated to decrease tension in the mooring line by using the moving fork 185 to raise the chain forerunner line segment 106 (while second fork 119 is retracted) to transfer load from the chain stopper or other line tension holder 112 to the chain jack of line tensioner 117, and then manually opening the one-way flapper mechanism of the chain stopper 112 (e.g., using ROV robotic arm). Then, with the flapper mechanism of the chain stopper 112 opened, the moving fork 185 of the chain jack of line tensioner 117 may be operated in reverse (while second fork 119 is retracted) to lower and feed the chain forerunner line segment 106 back down through the open chain stopper 112.

In order to remove as much line slack as possible prior to commencing the tensioning operation, the chain jack of line tensioner 117 may be opened by the ROV 110 to allow the chain to run freely upward past the forks of the chain jack. The lowering line 105 may be removed from the line tensioner 117 and connected by the ROV 110 to the loose end 114 of the chain forerunner line segment 106, and the lowering line 105 then hauled in or retrieved by the AHV 100 thereby removing excess slack in the mooring line including line segments 106, 108 and 109. The chain stopper 112 prevents chain direction reversal during removal of excess line slack. In one embodiment, the loose end 114 may be fitted with a soft sling of wire or synthetic rope and the lower end of the AHV 100 line 105 may be fitted with a connector or connection device such as a KS Hook (i.e. a hook modified for easy ROV handling). After the desired amount of line slack is removed, the AHV 100 may use the lowering line 105 to lay the line segment 106 across the turndown sheave 113.

Figure 5:
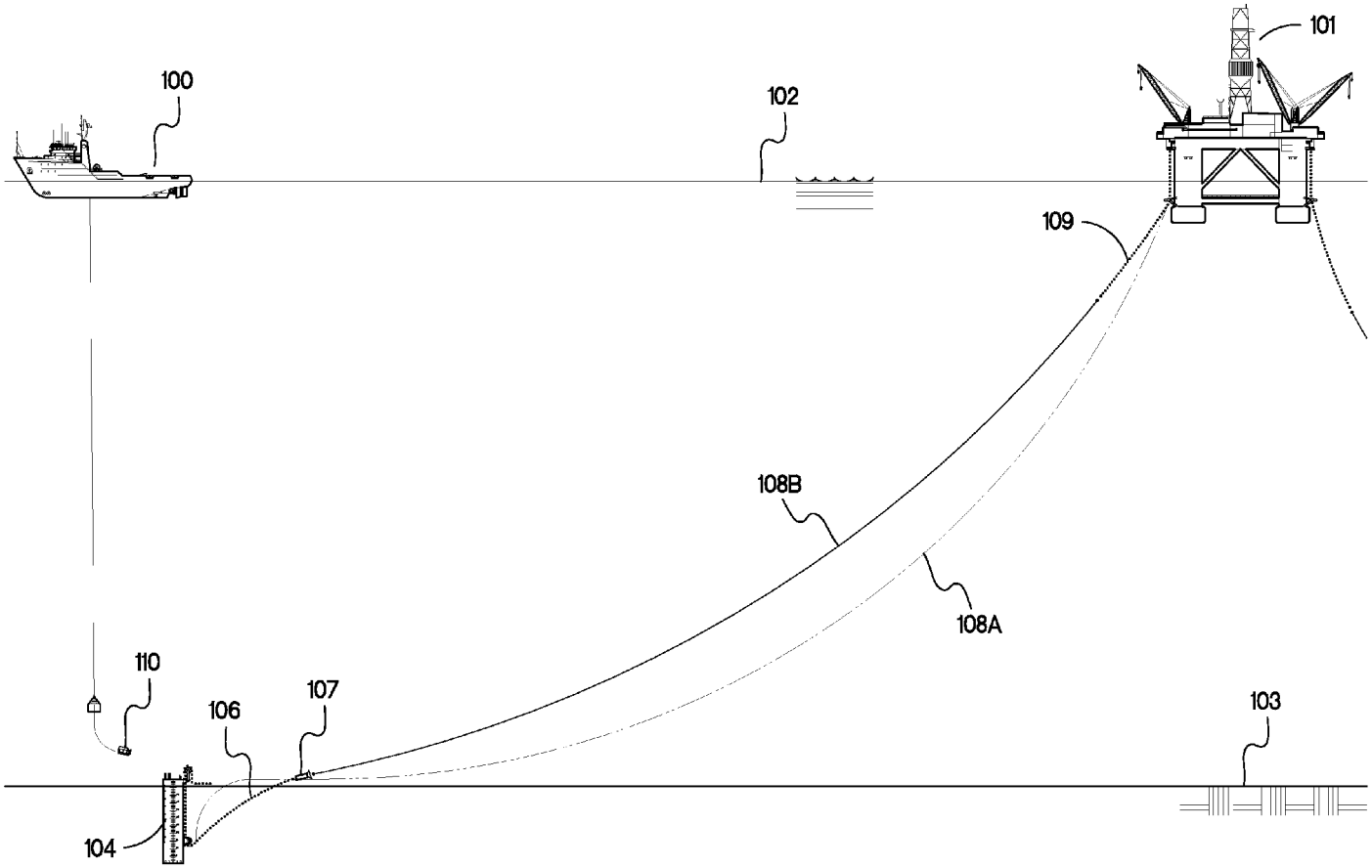
FIG. 5 illustrates a mooring line being tensioned using a submersible line-tensioning system according to one exemplary embodiment of the disclosed systems and methods.

FIG. 5 illustrates the net effect on the mooring line 108 of FIG. 2 after using the submerged line tensioner 117 of FIG. 4A to apply mooring tension at the submerged anchor 104 in the manner previously described. In particular, FIG. 5 shows the change in the suspended catenary of the mooring line from a less-tensioned state 108A to a more tensioned state 108B, as well as the inverse catenary of the anchor forerunner line segment 106 in the soil of the seafloor as the mooring line is tensioned by operation of submerged line tensioner 117. In this exemplary embodiment, the mooring line consists of the anchor forerunner line segment 106, subsea mooring connector part 107, mooring line middle segment(s) 108 and mooring line upper segment 109, although any other combination of one or more anchor line segments may be utilized as a mooring line. In one embodiment, ROV 110 may connect a first part of the subsea mooring connector that is attached to the lower end of mooring line 108 to a second mating part 107 of the subsea mooring connector that is parked in its support receptacle 131. Once the two parts of the subsea mooring connector 107 are latched together, the AHV 100 may retrieve mooring line 108 a short distance in order to lift the subsea mooring connector part 107 out of its support receptacle 131 and subsequently lay the forerunner line segment 106 and mooring line 108 towards the center of the mooring pattern. As described herein, tension in the mooring line may be increased by pulling a portion of an anchor line at the seafloor through a specially outfitted anchor pile 104 (in lieu of tension adjustment on the moored vessel 101). As further described, mooring line tension may be decreased if needed in one embodiment by configuring submerged line tensioner 117 and line tension holder 112 of a submerged anchor pile-mounted line-tensioning system to run in reverse. In one exemplary embodiment an amount of tension may be pre-selected and/or may be adjusted and readjusted as needed, e.g., to fit the original or changing tension needs or desires for a given mooring line installation. In a further exemplary embodiment, an amount of tension applied to the mooring line by submerged line tensioner 117 may be optionally measured and/or monitored in real time in any suitable manner, e.g., by using strain gauge/s placed in-line within a mooring line and/or at terminal ends of a mooring line, such as at the mooring line connection point to a floating vessel 101.

After the mooring line has been tensioned, line tensioner 117 may be optionally uncoupled and retrieved from the submerged anchor, e.g., using lowering line 105. In this case, line tensioner 117 may be a reusable modular component of a submersible line-tensioning system that may be moved between multiple anchor piles 104 and reused to tension other mooring lines that are coupled to other submerged anchor piles 104, with or without retrieving the line tensioner 117 to the surface when moving from one submerged anchor pile 104 to another submerged anchor pile 104 for mooring line tensioning operations. After line tensioner 117 has been uncoupled and removed from anchor pile 104, line tension holder 112 remains on anchor pile 104 and acts to permanently hold the tension in the mooring line segment/s. It will be understood that line tensioner 117 may be optionally returned as needed to a given submerged anchor pile 104 one or more times to readjust tension (e.g., to increase or decrease tension) in a mooring line coupled to the given anchor pile 104.

While the invention may be adaptable to various modifications and alternative forms, specific examples and exemplary embodiments have been shown by way of example and described herein. However, it should be understood that the invention is not intended to be limited to the particular forms disclosed. Rather, the invention is to cover all modifications, equivalents, and alternatives falling within the spirit and scope of the systems and methods described herein. Moreover, the different aspects of the disclosed systems and methods may be utilized in various combinations and/or independently. Thus the invention is not limited to only those combinations shown herein, but rather may include other combinations.

What is claimed is:

1. A method for tensioning a mooring line coupled to a vessel floating on a surface of a body of water that overlies a seafloor, comprising:

coupling one or more segments of the mooring line to extend from the vessel floating on the surface of the body of water to a submerged anchor pile that is at least partially embedded in the seafloor; and using a submerged line tensioner that is coupled to and mechanically supported by the submerged anchor pile to apply tension to the mooring line between the vessel floating on the surface and the submerged anchor pile.

2. The method of claim 1, further comprising lowering the line tensioner from the water surface to submerge the line tensioner and to mechanically mate and couple the line tensioner with the submerged embedded anchor pile prior to the step of using the submerged line tensioner to apply tension to the mooring line between the floating vessel and the submerged anchor pile.

3. The method of claim 2, further comprising uncoupling the line tensioner from the submerged embedded anchor pile after the step of using the submerged line tensioner to apply tension to the mooring line between the floating vessel and the submerged anchor pile.

4. The method of claim 2, further using a line tensioner guide and support structure that is integrated on the submerged anchor pile to orient and at least partially stabilize the line tensioner in correct operative mated position with the submerged embedded anchor pile.

5. The method of claim 1, further comprising lowering the anchor pile from the water surface to the seafloor, and at least partially embedding the anchor pile in the seafloor prior to the steps of coupling one or more segments of the mooring line to extend from the floating vessel to the submerged anchor pile that is at least partially embedded in the seafloor; and using a submerged line tensioner that is coupled to and mechanically supported by the submerged anchor pile to apply tension to the mooring line between the floating vessel and the submerged anchor pile.

6. The method of claim 1, further comprising lowering a remotely operated vehicle (ROV) from the water surface; and using the ROV to power the submerged line tensioner to apply tension to the mooring line between the floating vessel and the submerged anchor pile.

7. The method of claim 1, where a line tension holder is mechanically coupled to the submerged anchor pile with a forerunner line segment operatively received by the line tension holder; where the forerunner line segment is one of the mooring line segments; and where the method further comprises:

using the submerged line tensioner to move the forerunner line segment through the line tension holder in a first direction to apply tension to the mooring line between the floating vessel and the submerged anchor pile;

where the line tension holder maintains the tension applied to the mooring line by resisting movement of the forerunner line segment through the line tension holder in a second direction that is opposite to the first direction.

8. The method of claim 7, where the line tension holder is mechanically coupled to an upper end of the submerged anchor pile with a forerunner line segment operatively received by a mooring line fairlead mechanically coupled to a side of the anchor pile between the upper end and a lower end of the anchor pile; where the forerunner line segment extends downward from the line tension holder through the mooring line fairlead to one or more segments of the mooring line that extend from the floating vessel; and where the method further comprises:

using the submerged line tensioner to move the forerunner line segment through the mooring line fairlead and the line tension holder in the first direction to apply tension to the mooring line between the floating vessel and the submerged anchor pile.

9. The method of claim 8, where the forerunner line segment comprises a forerunner chain; where the line tensioner comprises a chain jack; where the line tension holder comprises a chain stopper; and where the method further comprises using the submerged chain jack to move the forerunner chain through the mooring line fairlead and the chain stopper in the first direction to apply tension to the mooring line between the floating vessel and the submerged anchor pile;

where the chain stopper maintains the tension applied to the mooring line by resisting movement of the forerunner chain through the chain stopper in a second direction that is opposite to the first direction.

10. The method of claim 7, where the line tension holder is configured to be selectably operated in a first mode of operation to maintain the tension applied to the mooring line by resisting movement of the forerunner line segment through the line tension holder in a second direction that is opposite to the first direction, and is further configured to be selectably operated in a second and different mode of operation to release the tension applied to the mooring line by allowing movement of the forerunner line segment through the line tension holder in a second direction that is opposite to the first direction; and where the method further comprises:

selectably configuring the line tension holder to operate in the second mode of operation; and using the submerged line tensioner to move the forerunner line segment through the line tension holder in the second direction to release tension in the mooring line between the floating vessel and the submerged anchor pile.

11. The method of claim 1, further comprising using the submerged line tensioner to apply tension to the mooring line between the floating vessel and the submerged anchor pile without applying any tension to the mooring line from the floating vessel.

12. A line-tensioning system, comprising:

a vessel floating on a surface of a body of water;

a mooring line that is coupled to the vessel;

an anchor pile having an upper end and a lower end, the anchor pile being coupled while submerged to one or more segments of the mooring line that is coupled to the vessel floating on a surface of a body of water while the lower end of the anchor pile is embedded in a seafloor; and a submersible line tensioner that is coupled to and mechanically supported by the anchor pile to apply tension to the mooring line extending between the vessel floating on the surface and the anchor pile while the anchor pile is submerged and the lower end of the anchor pile is embedded in the seafloor.

13. The system of claim 12, where the submersible line tensioner is configured to be lowered from the water surface to mechanically mate and couple with the anchor pile while the anchor pile is submerged and the lower end of the anchor pile is embedded in the seafloor.

14. The system of claim 13, where the submersible line tensioner is a modular component that is configured to be uncoupled from the anchor pile after tension has been applied to the mooring line between the floating vessel and the anchor pile while the anchor pile is submerged and the lower end of the anchor pile is embedded in the seafloor.

15. The system of claim 12, further comprising a line tensioner guide and support structure that is integrated on the anchor pile, the line tensioner being oriented and at least partially stabilized in correct operative mated position with the embedded anchor pile by the line tensioner guide and support structure.

16. The system of claim 12, where the submersible line tensioner is configured to use power received from a remotely operated vehicle (ROV) to apply tension to the mooring line between the floating vessel and the anchor pile while the anchor pile is submerged and the lower end of the anchor pile is embedded in the seafloor.

17. A submersible line-tensioning system, comprising:

an anchor pile having an upper end and a lower end, the anchor pile being coupled while submerged to one or more segments of a mooring line that is coupled to a vessel floating on a surface of a body of water while the lower end of the anchor pile is embedded in a seafloor; and a submersible line tensioner that is configured to be coupled to and mechanically supported by the anchor pile and to apply tension to the mooring line extending between the vessel floating on the surface and the anchor pile while the anchor pile is submerged and the lower end of the anchor pile is embedded in the seafloor; and a line tension holder coupled to the anchor pile, and a forerunner line segment movably coupled in operative relationship to the anchor pile and operatively received by the line tension holder; where the line tension holder is configured to be mechanically coupled to an upper end of the anchor pile while the anchor pile is submerged and the lower end of the anchor pile is embedded in the seafloor; where the forerunner line segment is configured to be coupled as one of the mooring line segments; and with the forerunner line segment operatively received by the line tension holder;

where the submersible line tensioner is configured to move the forerunner line segment through the line tension holder in a first direction to apply tension to the mooring line between the floating vessel and the anchor pile while the anchor pile is submerged and the lower end of the anchor pile is embedded in the seafloor and the forerunner line segment is coupled as one of the mooring line segments; and where the line tension holder is configured to maintain the tension applied to the mooring line by resisting movement of the forerunner line segment through the line tension holder in a second direction that is opposite to the first direction.

18. The system of claim 17, further comprising a mooring line fairlead mechanically coupled to a side of the anchor pile between the upper end and lower end of the anchor pile; and where the forerunner line segment extends from the line tension holder through the mooring line fairlead for coupling to one or more segments of the mooring line that extend from the floating vessel such that the forerunner line segment is moveable through the mooring line fairlead and the line tension holder in the first direction to apply tension to the mooring line between the floating vessel and the anchor pile while the anchor pile is submerged and the lower end of the anchor pile is embedded in the seafloor.

19. The system of claim 18, where the forerunner line segment comprises a forerunner chain; where the submersible line tensioner comprises a submersible chain jack; where the line tension holder comprises a chain stopper; and where the submersible chain jack is configured to move the forerunner chain through the mooring line fairlead and the chain stopper in the first direction to apply tension to the mooring line between the floating vessel and the anchor pile while the anchor pile is submerged and the lower end of the anchor pile is embedded in the seafloor and the forerunner line segment is coupled as one of the mooring line segments; and where the chain stopper is configured to maintain the tension applied to the mooring line by resisting movement of the forerunner chain through the chain stopper in a second direction that is opposite to the first direction.

20. The system of claim 17, where the line tension holder is configured to be selectably operated in a first mode of operation to maintain the tension applied to the mooring line by resisting movement of the forerunner line segment through the line tension holder in a second direction that is opposite to the first direction, and is further configured to be selectably operated in a second and different mode of operation to release the tension applied to the mooring line by allowing movement of the forerunner line segment through the line tension holder in a second direction that is opposite to the first direction; and where the submersible line tensioner is further configured to selectably move the forerunner line segment through the line tension holder in the second direction to release tension in the mooring line between the floating vessel and the anchor pile while the anchor pile is submerged and the lower end of the anchor pile is embedded in the seafloor and the forerunner line segment is coupled as one of the mooring line segments.

21. The method of claim 1, where the method further comprises using the submerged line tensioner to apply tension to the mooring line between the floating vessel and the submerged anchor pile to cause a suspended catenary of the tensioned mooring line to moor the floating vessel on the surface of the body of water in a position that is offset to the side from a position of the submerged anchor pile.

22. The method of claim 1, where the submerged anchor pile is a suction pile having a line tensioner guide and support structure coupled to the upper end of the submerged anchor pile; and where the method further comprises:

lowering the suction anchor pile with the coupled line tensioner guide and support structure from the water surface to the seafloor, and at least partially embedding the suction anchor pile in the seafloor; and then lowering the line tensioner from the water surface to submerge the line tensioner and to mechanically mate and couple the line tensioner with the line tensioner guide and support structure of the submerged embedded anchor pile prior to the step of using the submerged line tensioner to apply tension to the mooring line between the floating vessel and the submerged anchor pile.

23. The method of claim 1, where the submerged anchor pile; and where the method further comprises:

lowering the driven anchor pile from the water surface to the seafloor, and driving the driven anchor pile into the seafloor to at least partially embed the anchor pile in the seafloor;

then placing a line tensioner guide and support structure on the upper end of the submerged embedded anchor pile; and then lowering the line tensioner from the water surface to submerge the line tensioner and to mechanically mate and couple the line tensioner with the line tensioner guide and support structure of the submerged embedded anchor pile prior to the step of using the submerged line tensioner to apply tension to the mooring line between the floating vessel and the submerged anchor pile.

24. The method of claim 8, where the mooring line fairlead is an embedded mooring line fairlead that is mechanically coupled to the side of the embedded anchor pile at a point beneath the seafloor; where the submerged line tensioner is coupled to the embedded anchor pile above the seafloor; where the forerunner line segment extends downward into the seafloor from the line tension holder through the embedded mooring line fairlead to one or more segments of the mooring line that extend from the floating vessel; and where the method further comprises using the submerged line tensioner to move the forerunner line segment through the embedded mooring line fairlead and the line tension holder in the first direction to apply tension to the mooring line between the floating vessel and the submerged anchor pile from a point beneath the seafloor to moor the floating vessel on the surface of the body of water.

25. The method of claim 24, where the embedded mooring line fairlead is mechanically coupled to the side of the submerged anchor pile at a point closer to the embedded lower end of the submerged anchor pile than the upper end of the submerged anchor pile.

26. The method of claim 11, where the floating vessel is a Mobile Offshore Drilling Unit (MODU) that has no mooring line winches, or is a floating vessel having a turret mooring system with no mooring tensioning equipment on the turret.

27. The system of claim 12, where the submersible line tensioner is coupled to and mechanically supported by the anchor pile to apply tension to the mooring line extending between the floating vessel and the anchor pile cause a suspended catenary of the tensioned mooring line to moor the floating vessel on the surface of the body of water in a position that is offset to the side from a position of the submerged anchor pile.

28. The system of claim 18, where the mooring line fairlead is mechanically coupled to the side of the anchor pile in a position to be embedded beneath the seafloor while the lower end of the anchor pile is embedded in the seafloor and while the submersible line tensioner is positioned above the seafloor; where the forerunner line segment is configured to extend downward into the seafloor from the line tension holder through the mooring line fairlead while the lower end of the anchor pile is embedded in the seafloor for coupling to one or more segments of the mooring line that extend from the floating vessel such that the forerunner line segment is moveable through the embedded mooring line fairlead and the line tension holder in the first direction to apply tension to the mooring line between the floating vessel and the anchor pile from a point beneath the seafloor to moor the floating vessel on the surface of the body of water while the anchor pile is submerged and the lower end of the anchor pile is embedded in the seafloor.

29. The system of claim 28, where the mooring line fairlead is mechanically coupled to the side of the submerged anchor pile at a point closer to the lower end of the anchor pile than the upper end of the anchor pile.

30. The system of claim 12, where the floating vessel is a Mobile Offshore Drilling Unit (MODU) that has no mooring line winches, or is a floating vessel having a turret mooring system with no mooring tensioning equipment on the turret.

* * * * *